US006168468B1

(12) United States Patent
Zhu et al.

(10) Patent No.: US 6,168,468 B1
(45) Date of Patent: Jan. 2, 2001

(54) ELECTRICAL CONNECTOR

(75) Inventors: Zi-Qiang Zhu; Jian-Qiang Zhang; Zhong-Hua Yao, all of Kun-San (CN)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/421,469

(22) Filed: Oct. 19, 1999

(30) Foreign Application Priority Data

Jul. 6, 1999 (TW) ..... 88211235

(51) Int. Cl.[7] ..... H01R 13/648
(52) U.S. Cl. ..... 439/607
(58) Field of Search ..... 439/607–610, 439/79, 567

(56) References Cited

U.S. PATENT DOCUMENTS 5,637,015 * 6/1997 Tan et al. ..... 439/609
5,938,473 * 8/1999 Nishio et al. ..... 439/607
5,993,258 * 11/1999 Matsunuma et al. ..... 439/607

* cited by examiner

*Primary Examiner*—Gary F. Paumen
(74) *Attorney, Agent, or Firm*—Wei Te Chung

(57) ABSTRACT

An electrical connector comprises an insulative housing, a number of conductive contacts, a shell and a rear cover. Receiving slots are disposed in the insulative housing for receiving the conductive contacts. Positioning grooves are defined at a rear lower side of the insulative housing, and a number of bumps are disposed on opposite inside surfaces thereof to interferingly retain soldering sections of the conductive contacts. A stabilization device, stamped and formed from a bottom forward surface of the shell, aids in providing a stable mounting of the electrical connector on the printed circuit board. Thus the electrical connector is prevented from slanting forward on its mounting, assuring proper operation.

1 Claim, 5 Drawing Sheets

ELECTRICAL CONNECTOR

BACKGROUND OF THE INVENTION

The present invention relates to an electrical connector, and particularly to an electrical connector shielded by a shell which prevents the electrical connector from inclining after being mounted on a printed circuit board.

DESCRIPTION OF PRIOR ART

With the continuous miniaturization of notebook computers and similar products, there is a need for miniaturization of the electrical components within these products. Prior art Taiwan patent application Nos. 85217217, 86207971 and 86214118 and U.S. design Pat. No. 377,007 disclose universal serial bus (USB) connectors. An example of a longitudinal type of USB connector has an insulative housing with a rib configuration slot projecting from one side thereof to receive conductive contacts which are inserted from rear mating holes in the insulative housing. Additionally, a metal shell covers the insulative housing to shield the electrical connector from external EMI. In order to keep the metal shell from short-circuiting with a printed circuit board, an appropriate underlay is usually added to a bottom surface of the insulative housing. The underlay cooperates with a boardlock formed on a lateral side of the metal shell to mount the entire electrical connector onto the printed circuit board. However, using this means, the area of the underlay and the boardlock which contact directly with the printed circuit board are too small relative to the size of the entire electrical connector, and therefore provide a limited retaining force. In this case, if the USB connector covered by a metal shell has a fairly long soldering section, it may slant forward relative to the boardlock, thereby further affecting the reliability of the conductive contacts. Because the electrical connector slants forward and leans against the printed circuit board, a front port of the metal shell may not align with a corresponding opening defined in a metal panel, which is unacceptable in a finished product. Additionally, during the soldering of the conductive contacts to a printed circuit board, a slant to the electrical connector may easily cause soldering paste to wick up along the conductive contacts to the metal shell, shorting the metal shell and one or more contacts. Finally, unless the contact is securely retained on the printed circuit board, the stability and reliability of signal transmission will be affected.

BRIEF SUMMARY OF THE INVENTION

A first object of the present invention is to provide a shielded electrical connector having a stabilization device and a plurality of boardlocks for being soldered to a printed circuit board, thereby mounting the electrical connector securely thereon without slanting or leaning against the printed circuit board.

A second object of the present invention is to provide a positioning structure on the rear side of an insulative housing to interferingly retain conductive contacts and to simplify the manufacture of the conductive contacts.

An electrical connector according to the present invention comprises an insulative housing, a plurality of conductive contacts, a shell covering the outside surfaces of the insulative housing, and a rear cover. A plurality of receiving slots are defined in the insulative housing for receiving the conductive contacts. Positioning grooves are defined in a rear side of the insulative housing and each forms a plurality of bumps on opposite inside surfaces thereof. The said bumps interferingly retain soldering sections of the conductive contacts, making interfering appendages on the conductive contacts unnecessary, thereby simplifying contact production.

Additionally, a stabilization device is integrally stamped and formed from a bottom forward surface of the shell. The stabilization device comprises a latch leg depending vertically downward from the bottom forward surface thereof and a stabilization tab punched from an upper portion of the latch leg and parallel to the bottom surface of the shell. The latch leg may be inserted into an appropriate hole in the printed circuit board and the stabilization tab may be abutted against the printed circuit board, thereby providing a standoff between the electrical connector and the printed circuit board. Thus the stabilization device provides mounting stability to the electrical connector and prevents it from slanting forward.

Other objects, advantages and novel features of the invention will become more apparent from the following detailed description of the present embodiment when taken in conjunction with the accompanying drawings.

DETAILED DESCRIPTION OF THE INVENTION

Figure 1:
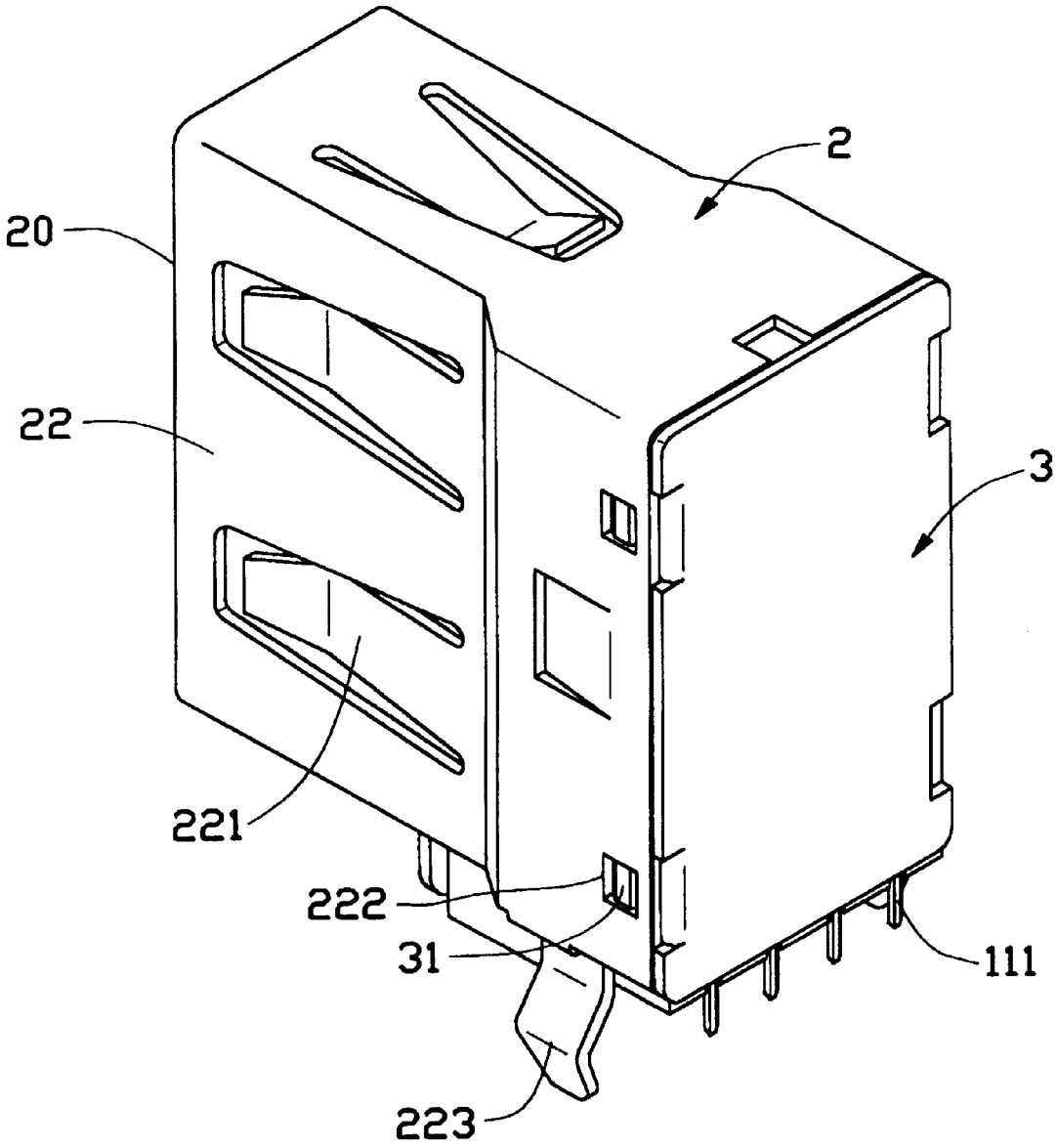
FIG. 1 is a perspective view of a rear aspect of an electrical connector of the present invention.
Figure 2:
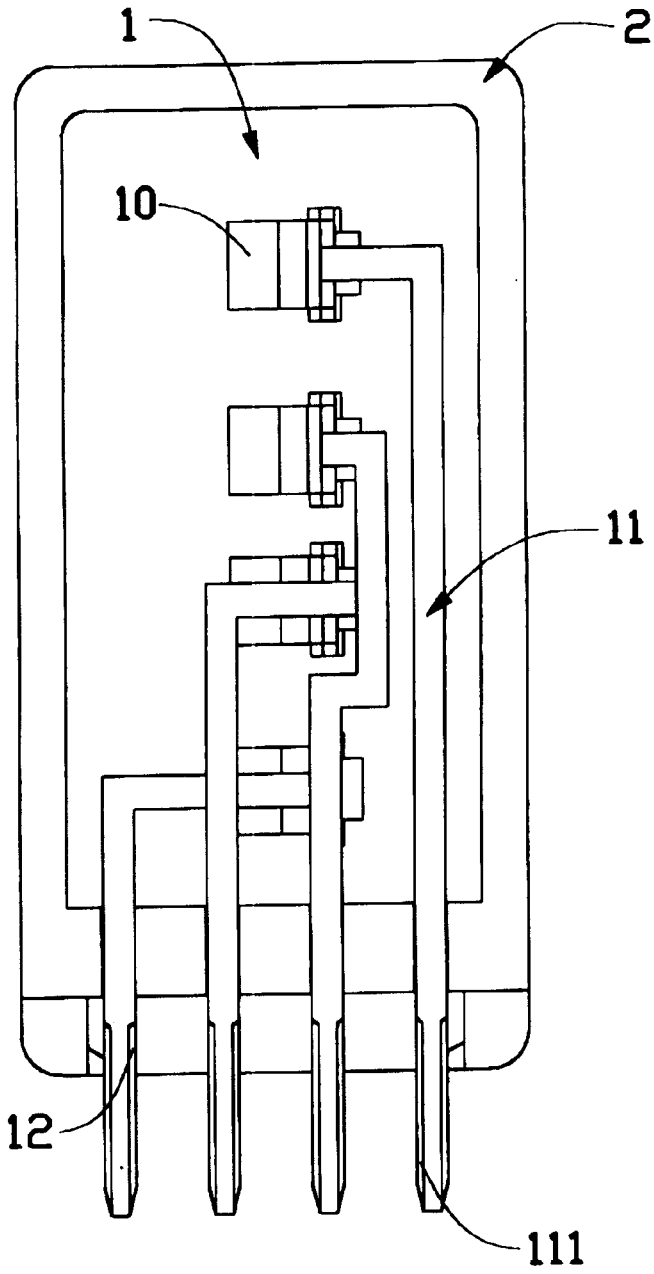
FIG. 2 is a rear plan view of FIG. 1 with a rear cover removed.

Referring to FIG. 1 and FIG. 2, an electrical connector of the present invention comprises an insulative housing 1, a plurality of conductive contacts 11, a shell 2 covering the insulative housing 1 and a rear cover 3.

Figure 3:
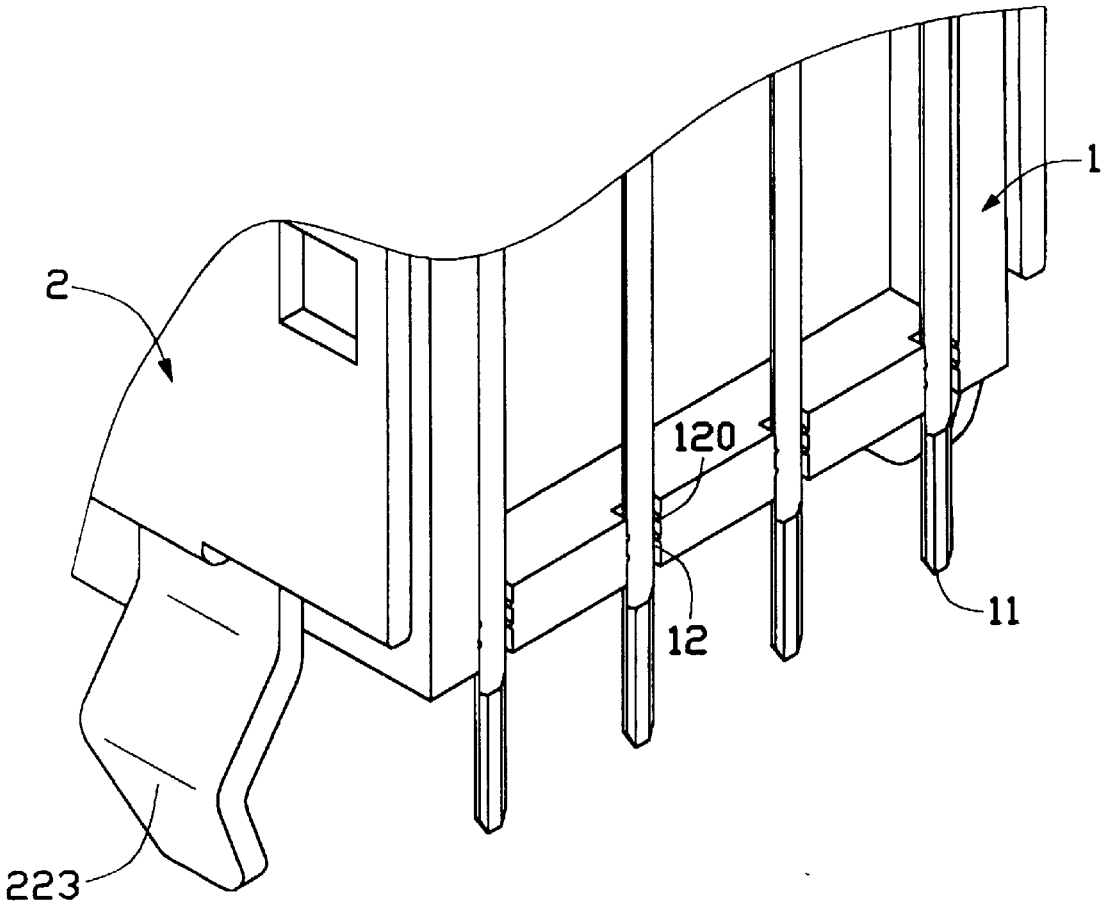
FIG. 3 is a partial enlarged view of FIG. 1 with the rear cover removed showing conductive contacts interferentially engaging with and exiting the connector housing of an electrical connector of the present invention.

The insulative housing 1 defines a plurality of receiving slots 10 which are longitudinally arranged for insertion of the conductive contacts 11 and a plurality of positioning grooves 12 (referring to FIG. 3) arranged transversely in a rear lower surface thereof. The positioning grooves 12 respectively define a plurality of bumps 120 on opposite inside surfaces thereof to interferingly retain soldering sections 111 of the conductive contacts 11.

Each of the conductive contacts 11 is bent generally in the shape of the letter "L". One end of the contact 11 comprises an engaging section (not shown) for engaging with a mating connector (not shown) and the other end thereof comprises a soldering section 111 for being soldered to a printed circuit board 5 (referring to FIG. 5).

The shell 2 comprises a body section 22 and a front port 20 and a rear port (not labeled) opposite the front port 20. The body section 22 is in a rectangular shape and comprises a plurality of spring arms 221 and at least two boardlocks 223. The spring arms 221 are defined on the outside surfaces of the body section 22 to clampingly engage outside surfaces of the mating connector. The boardlocks 223 are formed on opposite rear sides of the body section 22 to latch in the printed circuit board 5. The front port 20 of the shell 2 is provided for insertion of a mating end of the mating connector and aligns with an opening (not shown) disposed on a metal panel 4 (referring to FIG. 5).

The rear cover 3 defines a plurality of spring latches 31 on edges thereof to be latched in respective holes 222 defined adjacent to rear edges of the body section 22 of the shell 2.

Figure 4:
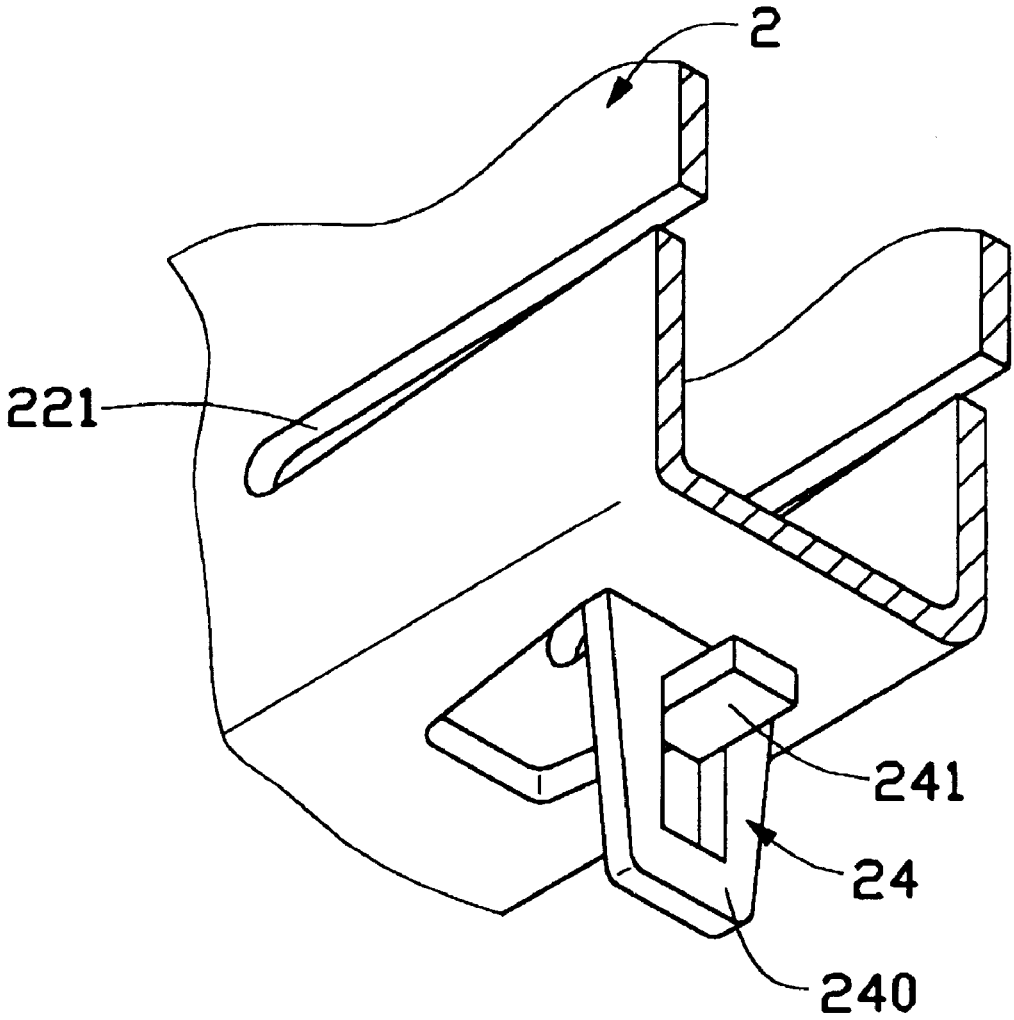
FIG. 4 is a partial enlarged view of a front bottom of a shell of an electrical connector of the present invention.
Figure 5:
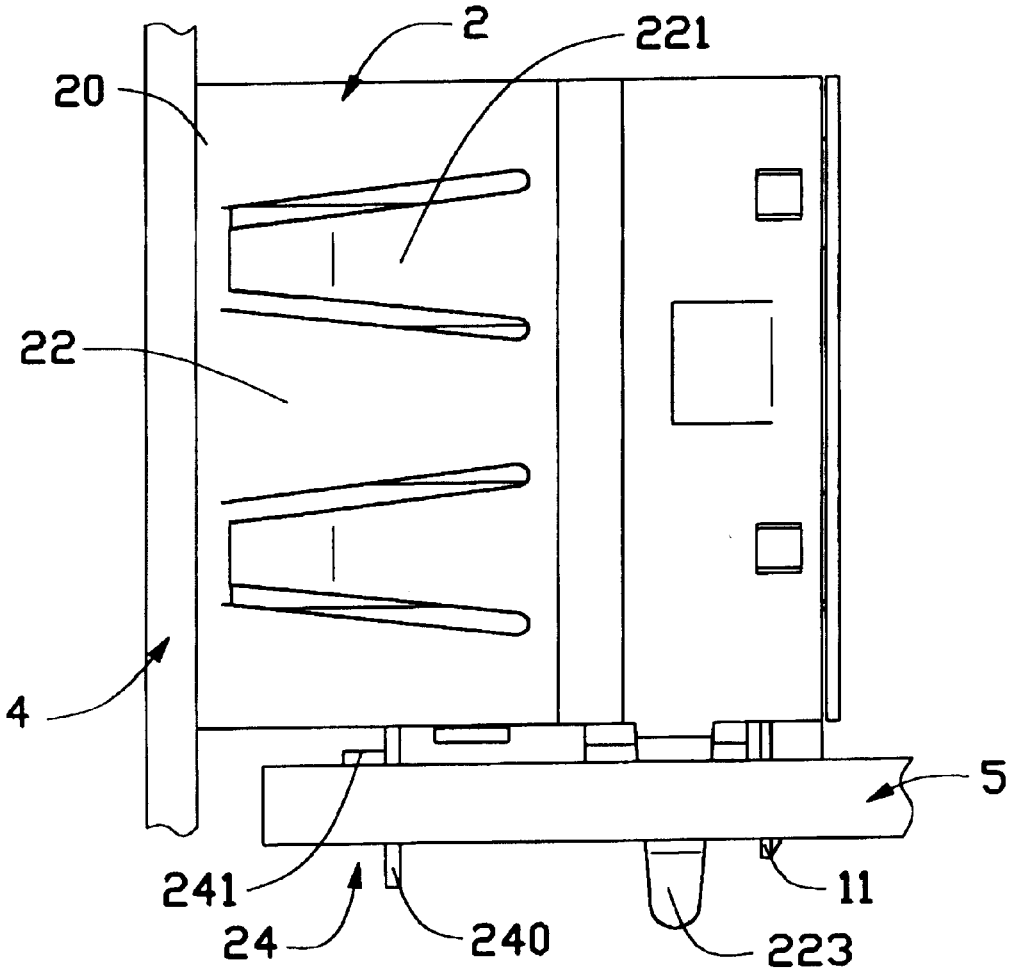
FIG. 5 is a side view of an electrical connector of the present invention mounted on a printed circuit board and abutting a panel.

Referring to FIGS. 4, 5, the bottom forward surface of the shell 2 forms a stabilization device 24, vertically stamped downward. The stabilization device 24 comprises a latch leg 240 and a stabilization tab 241. The latch leg 240 is vertical to the bottom surface of the shell 2 and is inserted into a corresponding hole (not shown) defined in the printed circuit board 5. The stabilization tab 241 is integrally stamped and formed from an upper portion of the latch leg 240 and extends parallel to the bottom surface of the shell 2. After arrangement, the stabilization tab 241 abuts against the printed circuit board 5, thereby providing a standoff function; and more importantly, preventing the electrical connector from slanting forward during use. The electrical connector is thus secured to the printed circuit board 5 at three locations: at a forward end by the latch leg 240, and at two rear sides by the boardlocks 223.

In assembly, the conductive contacts 11 are inserted into the insulative housing 1 from the rear thereof. The engaging sections of the conductive contacts 11 are first inserted into the receiving slots 10 and then the soldering sections 111 thereof are interferentially fitted in the positioning grooves 12 at the back of the insulative housing 1. The shell 2 covers the outside surfaces of the insulative housing 1, thereby providing EMI shielding, and the rear cover 3 is assembled to the rear port of the shell 2. The electrical connector is mounted to the printed circuit board 5 by soldering the stabilization device 24, the boardlock-s 223 and the conductive contacts 11 to the printed circuit board 5. Finally, when the printed circuit board 5 is mounted in a computer, the front port 20 of the shell 2 is aligned with the opening in the metal panel 4 of the computer. Thus the electrical connector is securely positioned.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on a printed circuit board for mating with an external electrical component, comprising:

an insulative housing including a plurality of receiving slots and a plurality of positioning grooves, each of the positioning grooves forming a plurality of bumps on opposite inner surfaces thereof;

a plurality of conductive contacts being received in the receiving slots of the insulative housing and respectively defining at one end thereof a soldering section retained by the bumps of the positioning groove of the insulative housing;

a metal shell covering the insulative housing and including a body section and a stabilization device supported on the printed circuit board to stand the body section off the printed circuit board; and a rear cover covering a rear port of the shell;

wherein the positioning grooves are arranged transversely in a rear lower surface of the insulative housing;

wherein the stabilization device is integrally formed from a bottom forward surface of the shell and comprises a latch leg and a stabilization tab;

wherein the latch leg of the stabilization device is stamped and formed with the shell and extends vertically from the bottom surface of the shell;

wherein the stabilization tab of the stabilization device is integrally stamped and formed on the latch leg and extends parallel to the bottom surface of the shell;

wherein the body section of the shell defines a plurality of spring arms on outside surfaces thereof to clampingly engage an outside surface of the external electrical component;

wherein the body section of the shell defines at least two boardlocks on opposite rear sides thereof for latching to the printed circuit board.

* * * * *